United States Patent [19]

Caste

[11] Patent Number: 4,554,426

[45] Date of Patent: Nov. 19, 1985

[54] MULTIPLE KEY WITH INVISIBLE HINGE

[75] Inventor: Thomas K. Caste, Chesapeake, Va.

[73] Assignee: General Electric Company, Portsmouth, Va.

[21] Appl. No.: 586,383

[22] Filed: Mar. 5, 1984

[51] Int. Cl.[4] ..... H01H 3/12

[52] U.S. Cl. ..... 200/159 B; 200/5 A; 200/340

[58] Field of Search ..... 200/159 B, 340, 159 A, 200/72 R, 75, 5 A

[56] References Cited

U.S. PATENT DOCUMENTS

| | | | |
|---|---|---|---|
| 3,691,324 | 9/1972 | Brantingson | 200/5 A |
| 3,800,104 | 3/1974 | Lien et al. | 200/159 A |
| 4,029,916 | 6/1977 | Chu | 200/159 B |
| 4,190,748 | 2/1980 | Langford | 200/159 B |
| 4,256,931 | 3/1981 | Palisek | 200/5 A |

FOREIGN PATENT DOCUMENTS

| | | | |
|---|---|---|---|
| 3228241 | 2/1984 | Fed. Rep. of Germany | 200/5 A |

*Primary Examiner*—Stephen Marcus
*Assistant Examiner*—Renee S. Kidorf

[57] ABSTRACT

A printed circuit keyboard of the type comprising a face plate (10) having apertures through which keys (11) project, a resilient silicone rubber pad (12) having convex dimples (15) which engage the bases (14) of the keys, and a printed circuit board (13) having key pad contacts (16) which are bridged by the electrically conductive concave inner surface of a corresponding dimple when a key is depressed is improved by joining two or more keys together with a common base. When one key is depressed the others act as a hinge. This improves key pad contact since the hinge action causes the key to always come down the same way. This also improves the key "feel" since the hinge action will not allow the key to wobble on its descent. Embodiments of two, three and four keys joined with a common base are disclosed.

7 Claims, 9 Drawing Figures

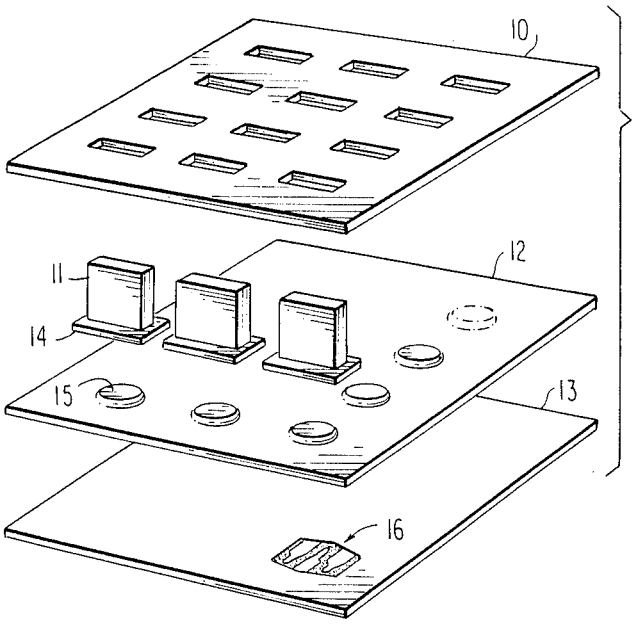
FIG. 1 PRIOR ART
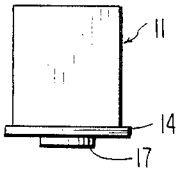
FIG. 2
PRIOR ART
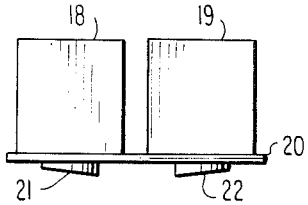
FIG. 3
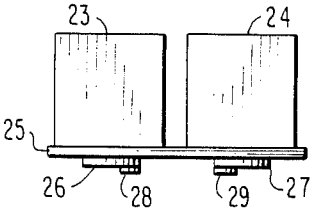
FIG. 4
FIG. 4A
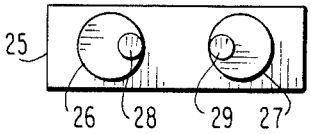
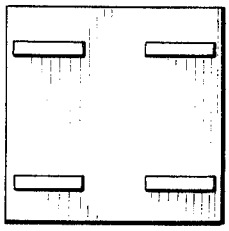
FIG. 6
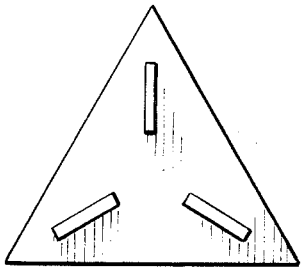
FIG. 5
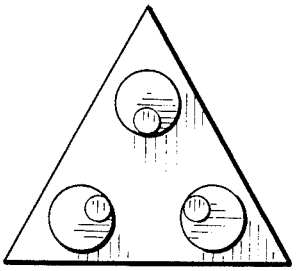
FIG. 5A
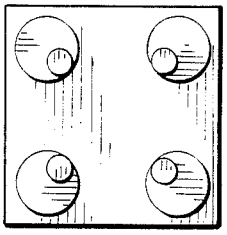
FIG. 6A

MULTIPLE KEY WITH INVISIBLE HINGE

BACKGROUND OF THE INVENTION

The present invention generally relates to keyboard assemblies of the type that use a plastic key to compress a silicone rubber pad so that a conductive layer on the pad bridges a plurality of contact pads on a printed circuit board thereby completing an electrical circuit, and more particularly the invention is directed to improvements in such assemblies that make operation of the keyboard more reliable and provide a better "feel" to the operator.

Keyboard assemblies of the type to which the present application is directed are used in a variety of consumer electronic products and appliances such as television receivers, calculators, security system keyboards and the like. The invention is not, however, limited to any particular application and has utility in any application where improved reliability of operation and enhanced user "feel" are desired.

In recent years, the trend in the design of keyboards for user input to an electronic device or system has been to make the keyboard as thin as possible. There has evolved a keyboard assembly having a thin sandwich construction comprising a face plate through which individual keys project, a silicone rubber pad and a printed circuit board. The individual keys have an enlarged base which serves to retain the key within the face plate. This enlarged base engages a corresponding convex dimple formed in the silicone rubber pad that acts as the return spring for the key when it is pressed and then released. On the opposite side of the convex dimple is a conductive coating which, when the key is depressed, bridges a plurality of contact pads on the printed circuit board. One common design employs three contact pads in an offset alignment to allow for a close spacing of the pads. The center pad is connected to electrical ground, and in order to insure proper operation of any given key, the other two pads must be electrically connected to the center pad by operation of the key.

This keyboard assembly design produces a pleasing appearance which has found good commercial acceptance. However, by making the keyboard assembly very thin, very little lateral support is provided for the keys as they reciprocate within the apertures of the face plate. As a result, unless the user is careful in depressing a key, the key may be depressed at an angle to the printed circuit board. This can cause the silicone rubber pad to bridge only two of the three pads or perhaps only one of the three pads resulting in an erroneous keyboard input. Moreover, the poor wobbly feel of the keys is not desirable for attaining commercial acceptance.

SUMMARY OF THE INVENTION

It is therefore an object of the present invention to provide improvements in keyboard assemblies that increase the reliability of operation.

It is another object of this invention to provide a keyboard assembly having an improved "neel" of operation.

These and other objects of the invention are attained by joining two, three or four keys together on the side of the face plate adjacent the silicone rubber pad so that when one key is depressed, the other key or keys act as an invisible hinge. Thus, the depressed key is made to move in a defined arc against not only the resilient convex dimple in the silicone pad for that particular key but also to a lesser extent against the resilient dimple or dimples for the key or keys to which it is joined. Since the key moves in a defined arc rather than perpendicularly to the printed circuit board, the base of the key must be provided with a surface that will cause the conductive surface on the opposite side of the silicone pad to bridge all of the contact pads. This may be done by giving the base of the key a bevel edge which is parallel to the printed circuit board when the key is fully depressed. Alternatively, advantage may be taken of the inherent stiffness of the contact area of the silicone rubber pad by giving the base of the key an offset projection such that when a line is drawn from the projection to the opposite edge of the key base, the outline of the required bevel edge is generated. The latter approach was used in an actual reduction to practice of the invention and proved to work quite well. In either case, improved pad contact is obtained since the hinge action causes the key to always come down the same way. And because the hinge action does not allow the key to wobble on its descent, the "feel" of the key is greatly improved.

BRIEF DESCRIPTION OF THE DRAWINGS

The foregoing and other objects, advantages and aspects of the invention will be better understood from the following detailed description of the invention with reference to the drawings, in which:

FIG. 1 is an exploded view of a conventional keyboard assembly known in the art;

FIG. 2 is a side view of an individual key in the keyboard assembly shown in FIG. 1;

FIG. 3 is a side view of a pair of keys joined together according to the present invention, these keys having beveled contact surfaces; FIG. 4 is a side view of a pair of keys joined together according to the present invention, these keys being provided with offset projections on their contact surfaces;

FIG. 4A is a plan view of the base of the keys shown in FIG. 4;

FIG. 5 is a top view of three keys joined together according to the present invention;

FIG. 5A is a plan view of the base of the keys shown in FIG. 5;

FIG. 6 is a top view of four keys joined together according to the present invention; and FIG. 6A is a plan view of the base of the keys shown in FIG. 6.

DETAILED DESCRIPTION OF THE INVENTION

Referring now to the drawings and more particularly to FIG. 1, the basic construction of a printed circuit keyboard is shown as comprising a face plate 10 having a plurality of apertures through which keys 11 project, a silicone rubber pad 12, and a printed circuit board 13. The keys 11 are provided with an enlarged base 14 which serves to retain the key within the assembly and which also engages a corresponding convex dimple 15 in the silicone rubber pad 12. This dimple 15 acts as a return spring for the key 11 after it is depressed and then released. Although not shown in the figure, the opposite or concave surface of the dimples 15 are provided with an electrically conductive coating so that when a key is depressed, this coating will bridge the contact pads 16 on the printed circuit board 13 thereby electrically connecting these pads. As shown in FIG. 2, each key may be provided not only with an enlarged base 14, but also with a surface 17 designed to provide a good "foot print" over the contact pads 16.

According to the present invention, the basic structure of the printed circuit keyboard shown in FIG. 1 is retained. Specifically, no alteration is made to the face plate 10, the silicone rubber pad 12 or the printed circuit board 13. Instead, individual keys are joined together at their bases. One example is shown in FIG. 3 in which two keys 18 and 19 are joined with a common base 20. This pair of keys is then simply substituted for two adjacent keys 11 in the keyboard assembly shown in FIG. 1. Now, when key 18 for example is depressed, it will tend to pivot about the opposite edge of key 19 since both keys are resiliently biased by the pad 12. Key 18 therefore moves in a more or less definite arcuate path as it decends toward the printed circuit board 13. To account for this, key 18 is provided with a beveled contact surface 21 that projects further toward the printed circuit board adjacent key 19 and slopes away toward its opposite side. The exact amount of the bevel will depend on specific dimensions of the keyboard assembly and the amount of travel of the key but may be described as being parallel to the printed circuit board when the key is fully depressed. It will be observed that the contact surface 22 provided for key 19 is the mirror image of that provided key 18 since key 19 will move in an arcuate path about the opposite edge of key 18 when it is depressed.

Rather than provide the keys with beveled surfaces as shown in FIG. 3, a preferred embodiment of the invention has been constructed as shown in FIG. 4. Here, a pair of keys 23 and 24 are joined by a common base 25 and provided with contact surfaces 26 and 27. These contact surfaces are not beveled but instead are provided with projections 28 and 29 located at the adjacent edges of the surfaces. This embodiment takes advantage of the relative stiffness of the dimple area of the silicone rubber pad 12 which provides good center contact with the printed circuit board pads when only the opposite edges of the dimple are depressed. The advantage of the embodiment shown in FIG. 4 over that shown in FIG. 3 is that less expensive molds are required to make it. Performance, however, of the two embodiments is the same.

The principles of the invention are not limited to joining only pairs of keys. As shown in FIG. 5, three keys can be joined with a common triangular base. FIG. 5A shows the contact surfaces of the three keys. Note that the projections for these contact surfaces are located on lines which bisect the angles of the triangles. The hinge point is located along the triangular base opposite the key being depressed. The arrangement shown in FIGS. 5 and 5A clearly would not be usable in the assembly shown in FIG. 1. Nevertheless, those skilled in the art will readily understand the principles of operation for this particular configuration.

The four key embodiment shown in FIGS. 6 and 6A can be used in the assembly shown in FIG. 1. This embodiment is very similar to the two key embodiment shown in FIGS. 4 and 4A. Note however in FIG. 6A that the projections of each of the contact surfaces are located along diagonal lines of the common square base. The hinge point for this embodiment is diagonally opposite the key being depressed.

From the foregoing, it will be appreciated that the present invention provides a simple and inexpensive solution to the problem of key wobble in printed circuit keyboard assemblies. This solution requires no major modification of the keyboard assembly yet greatly improves the reliability of operation of the keyboard and the "feel" of operation of the keys.

I claim:

1. A printed circuit keyboard comprising:

a face plate having a plurality of apertures;

a plurality of keys projecting through said apertures of said face plate;

a resilient pad having convex dimples which engage the bases of said plurality of keys, each of said convex dimples having an electrically conductive concave inner surface;

a printed circuit board having a plurality of key pads in registry with said plurality of keys, each of said key pads being arranged to be bridged by said electrically conductive concave inner surface of an adjacent dimple of said resilient pad when a corresponding key is depressed; and at least two of said keys being joined to a common base and formed as a unitary structure therewith so that depression of one key of said unitary structure will cause it to move in an arucate path about a hinge area located along said common base outside of the area of juncture of the depressed key with said common base, said unitary structure providing lateral support to said at least two keys independent of the thickness of said face plate thereby allowing said printed circuit keyboard to be manufactured with a thin face plate.

2. The printed circuit keyboard as recited in claim 1 wherein each key is provided with a contact surface which is substantially parallel to the printed circuit board when the key is fully depressed.

3. The printed circuit keyboard as recited in claim 2 wherein the contact surfaces of the keys are beveled.

4. The printed circuit keyboard as recited in claim 2 wherein the contact surfaces of the keys are provided with projections at the edge of the contact surface closest to the hinge area.

5. The printed circuit keyboard as recited in claim 2 wherein two keys are joined with a common rectangular base.

6. The printed circuit keyboard as recited in claim 2 wherein three keys are joined with a common triangular base.

7. The printed circuit keyboard as recited in claim 2 wherein four keys are joined with a common square base.

* * * * *